US006227589B1

(12) United States Patent
Brown et al.

(10) Patent No.: US 6,227,589 B1
(45) Date of Patent: May 8, 2001

(54) GRIPPER ASSEMBLY FOR A CONVEYING DEVICE FOR CONVEYING SINGLE-SHEET OR MULTI-SHEET PRINTED PRODUCTS AND A METHOD FOR MODIFYING THE SAME

(75) Inventors: James E. Brown, Drexel Hill; Jeffrey R. Simons, Elkins Park, both of PA (US)

(73) Assignee: Philadelphia Newspapers, Inc.

( * ) Notice: Subject to any disclaimer, the term of this patent is extended or adjusted under 35 U.S.C. 154(b) by 0 days.

(21) Appl. No.: 09/456,149

(22) Filed: Dec. 7, 1999

Related U.S. Application Data

(60) Provisional application No. 60/168,283, filed on Dec. 1, 1999.

(51) Int. Cl.[7] ..... B65G 47/86

(52) U.S. Cl. ..... 294/104; 294/99.1; 198/803.7; 271/204; 271/277

(58) Field of Search ..... 294/104, 116, 294/99.1; 198/803.7, 803.9; 271/204, 277

(56) References Cited

U.S. PATENT DOCUMENTS

| | | | | |
|---|---|---|---|---|
| 4,381,056 | | 4/1983 | Eberle | 198/803.7 |
| 4,505,378 | * | 3/1985 | Statkus | 271/204 |
| 4,629,176 | * | 12/1986 | Ceelen | 271/204 |
| 4,638,906 | | 1/1987 | Winiasz | 198/803.9 |
| 4,681,213 | | 7/1987 | Winiasz | 198/803.9 |
| 4,854,626 | * | 8/1989 | Duke | 294/104 |
| 4,878,577 | * | 11/1989 | Romero Liedo et al. | 198/803.9 |
| 4,905,818 | | 3/1990 | Houseman | 198/803.7 |
| 4,921,294 | | 5/1990 | Klopfenstein | 294/99.1 |
| 4,968,081 | * | 11/1990 | Beight et al. | 271/204 |

(List continued on next page.)

*Primary Examiner*—Dean J. Kramer
*Assistant Examiner*—Paul T. Chin
(74) *Attorney, Agent, or Firm*—Dechert

(57) ABSTRACT

A gripper assembly for a conveying device for conveying printed products. More particularly, a gripper assembly having: (a) a first gripper part, having a clamping surface and an external surface; (b) a second gripper part, having a clamping surface and an external surface; wherein the first gripper part and the second gripper part are connected together for pivotal movement about a common axis, the first gripper part being pivotable between an open position and a clamping position in which it cooperates with the second gripper part to clamp a printed product under spring force; (c) a spring element arranged between the first gripper part and the second gripper part, which spring element imparts a biasing force on the first gripper part which biases the first gripper part into the clamping position; and, (d) at least one conforming biaser which conforms to the external surfaces of the first and second gripper parts and which biases the first gripper part into the clamping position. The present invention also provides a method for modifying a conventional gripper assembly to facilitate the improved handling of periodic large or heavy editions, for example, the Sunday edition of a daily newspaper, which method includes the installation of at least one conforming biaser into a conventional gripper assembly, wherein the conventional gripper assembly comprises: (a) a first gripper part, having a clamping surface and an external surface; (b) a second gripper part, having a clamping surface and an external surface; wherein the first gripper part and the second gripper part are connected together for pivotal movement about a common axis, the first gripper part being pivotable between an open position and a clamping position in which it cooperates with the second gripper part to clamp a printed product under spring force; and, (c) a spring element arranged between the first gripper part and the second gripper part, which spring element imparts a biasing force on the first gripper part which biases the first gripper part into the clamping position.

20 Claims, 5 Drawing Sheets

U.S. PATENT DOCUMENTS

| | | | | |
|---|---|---|---|---|
| 5,128,726 | * | 7/1992 | Cassano et al. | 271/277 |
| 5,199,757 | * | 4/1993 | Simeth | 294/104 |
| 5,244,078 | | 9/1993 | Silva et al. | 198/464.3 |
| 5,328,017 | | 7/1994 | Carlen | 198/890 |
| 5,350,167 | | 9/1994 | Hansch | 271/82 |
| 5,356,128 | | 10/1994 | Eberle et al. | 271/204 |
| 5,360,101 | | 11/1994 | Carlen | 198/803.7 |
| 5,374,093 | * | 12/1994 | Klopfenstein | 294/104 |
| 5,388,820 | | 2/1995 | Eberle et al. | 271/277 |
| 5,393,047 | * | 2/1995 | Ahl et al. | 271/204 |
| 5,395,151 | | 3/1995 | Eberle | 294/104 |
| 5,465,952 | | 11/1995 | Eberle et al. | 271/204 |
| 5,518,231 | * | 5/1996 | Reddy | 271/204 |
| 5,575,379 | * | 11/1996 | Schmetzer | 198/803.7 |

* cited by examiner

GRIPPER ASSEMBLY FOR A CONVEYING DEVICE FOR CONVEYING SINGLE-SHEET OR MULTI-SHEET PRINTED PRODUCTS AND A METHOD FOR MODIFYING THE SAME

This application claims the benefit of U.S. Provisional Application No. 60/168,283, filed Dec. 1, 1999.

The present invention relates to a gripper assembly for a conveying device for conveying "printed products". More particularly, the present invention is directed to a gripper assembly.

For the purposes of the present application "printed products" includes paper and paper-like products, e.g., plastics, thin metal and metallized sheets, etc.

Conveying devices for conveying printed products such as newspapers, magazines or other like flat articles typically incorporate a plurality of gripper assemblies. These gripper assemblies operate to clamp a printed product to facilitate the pick-up and transportation of that printed product to another location where the gripper assembly opens, releasing the printed product to facilitate the drop-off thereof. For example, newspapers typically come off a printing press at a rate of about 75,000 copies per hour. After coming off the printing press, the individual newspapers must be transported to various pieces of equipment for further processing. This transportation is usually performed using a chain conveyor having a plurality of gripper assemblies attached thereto. The gripper assemblies pick-up and securely hold a newspaper by clamping the edge of the newspaper inserted into the gripper assembly. When the newspaper is to be deposited at the next piece of equipment for further processing, the gripper assembly releases its hold on the newspaper, which is dropped-off.

Gripper assemblies are typically spring biased to a clamping position. Accordingly, to facilitate the pick-up and drop-off of a printed product, the gripper assembly must be transitioned into an open position. The gripper assemblies are transitioned into an open position by the exertion thereon of an opening force. This opening force is imparted to the gripper assemblies using a variety of devices known in the art. Considering that the gripper assemblies are transitioned from an open to a clamping position repeatedly, one can easily recognize that wear and tear on both the gripper assemblies specifically and on the gripper conveyors generally can be reduced by minimizing the strength of the spring force biasing the gripper assemblies into the clamping position. Likewise, maintenance on the gripper assemblies specifically and on the gripper conveyors generally may be reduced by minimizing the strength of the force biasing the gripper assemblies into the clamping position.

Notwithstanding, the composition of printed products often varies. For example, newspapers typically have outer sections printed on a relatively rough paper having a high coefficient of friction making it easy to grip. Nevertheless, newspapers may also have one or more inner sections printed on a relatively smooth paper having a low coefficient of friction. Due to this low coefficient of friction, the inner section may tend to slip relative to the outer section of the newspaper while it is being held by a gripper assembly. In addition, the size and weight of printed products often varies. For example, the Sunday edition of a daily newspaper is often significantly larger and heavier than the average daily edition of the same newspaper. To exacerbate things, Sunday editions of daily newspapers frequently contain one or more inner sections printed on paper having a low coefficient of friction.

Accordingly, what is needed is a method for quickly and easily modifying gripper assemblies in a gripper conveyor to facilitate the handling of periodic editions of increased size and weight or of a composition which otherwise requires greater clamping strength to handle. That is, a method by which gripper assemblies may periodically be modified to provide increased clamping strength to facilitate the handling of periodic editions of increased size and weight or of a composition which otherwise requires such increased clamping strength.

To achieve these and other objects of the present invention, a conforming biaser is provided for a gripper assembly for a conveying device for conveying printed products. The conforming biaser operates to increase the clamping force exerted by the gripper assembly.

SUMMARY OF THE INVENTION

The present invention provides a gripper assembly for a conveying device for conveying single-sheet or multi-sheet printed products, preferably newspapers. Specifically, the present invention provides a gripper assembly with an increased clamping force to facilitate the handling of periodic large or heavy issues, for example, the Sunday edition of a daily newspaper. The invention also provides a method for modifying gripper assemblies to facilitate the periodic handling of such large or heavy issues.

In accordance with one aspect the present invention, a gripper assembly is provided, having: (a) a first gripper part, having a clamping surface and an external surface; (b) a second gripper part, having a clamping surface and an external surface; wherein the first gripper part and the second gripper part are connected together for pivotal movement about a common axis, the first gripper part being pivotable between an open position and a clamping position in which it cooperates with the second gripper part to clamp a printed product under spring force; (c) a spring element which is arranged between the first gripper part and the second gripper part and which biases the first gripper part into the clamping position; and (d) at least one conforming biaser, wherein the at least one conforming biaser conforms to the external surfaces of the first and second gripper parts and imparts a force biasing the first gripper part into the clamping position.

In a preferred embodiment of this aspect of the present invention, the at least one conforming biaser slides into engagement with the external surfaces of the first and second gripper parts.

In yet another preferred embodiment of this aspect of the present invention, the force imparted by the at least one conforming biaser further operates to marry the conforming biaser to the external surfaces of the first and second gripper parts.

In still yet another preferred embodiment of this aspect of the present invention, the external surface of at least one of the first gripper part and the second gripper part has at least one elevated ridge, which at least one elevated ridge is preferably perpendicular to the common axis and preferably cooperates with the at least one conforming biaser to seat the at least one conforming biaser in a particular location on the external surface of at least one of the first and second gripper parts. More preferably, the external surface of at least one of the first gripper part and the second gripper part comprises at least two pair of elevated ridges. Still more preferably, the external surface of at least one of the first gripper part and the second gripper part comprises at least two pair of elevated ridges which are parallel to one another. Yet still more preferably, the external surface of at least one of the first gripper part and the second gripper part comprises at least two pair of elevated ridges which are parallel to one another and perpendicular to the common axis.

In yet another preferred aspect of this embodiment of the present invention, the at least one conforming biaser may be installed and removed from the gripper assembly without the use of tools.

In accordance with another aspect of the present invention, a method is provided for modifying a gripper assembly to facilitate the improved handling of periodic large or heavy issues of printed matter, for example, the Sunday edition of a daily newspaper, which method comprises the installation of at least one conforming biaser into a gripper assembly having: (a) a first gripper part, having a clamping surface and an external surface; (b) a second gripper part, having a clamping surface and an external surface; wherein the first gripper part and the second gripper part are connected together for pivotal movement about a common axis, the first gripper part being pivotable between an open position and a clamping position in which it cooperates with the second gripper part to clamp a printed product under spring force; and, (c) a spring element which is arranged between the first gripper part and the second gripper part and which biases the first gripper part into the clamping position.

In a preferred embodiment of this aspect of the present invention, the at least one conforming biaser may be installed and removed from the conventional gripper assembly without the use of tools.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the spirit and scope of the appended claims.

In the drawings.

DETAILED DESCRIPTION OF THE INVENTION

The following is a detailed description of the invention. The description is not intended in a limiting sense, and it is made solely for the purpose of illustrating the general principles of the invention. The various features and advantages of the present invention may be more readily understood with reference to the following detailed description taken in conjunction with the accompanying drawings.

Figure 1:
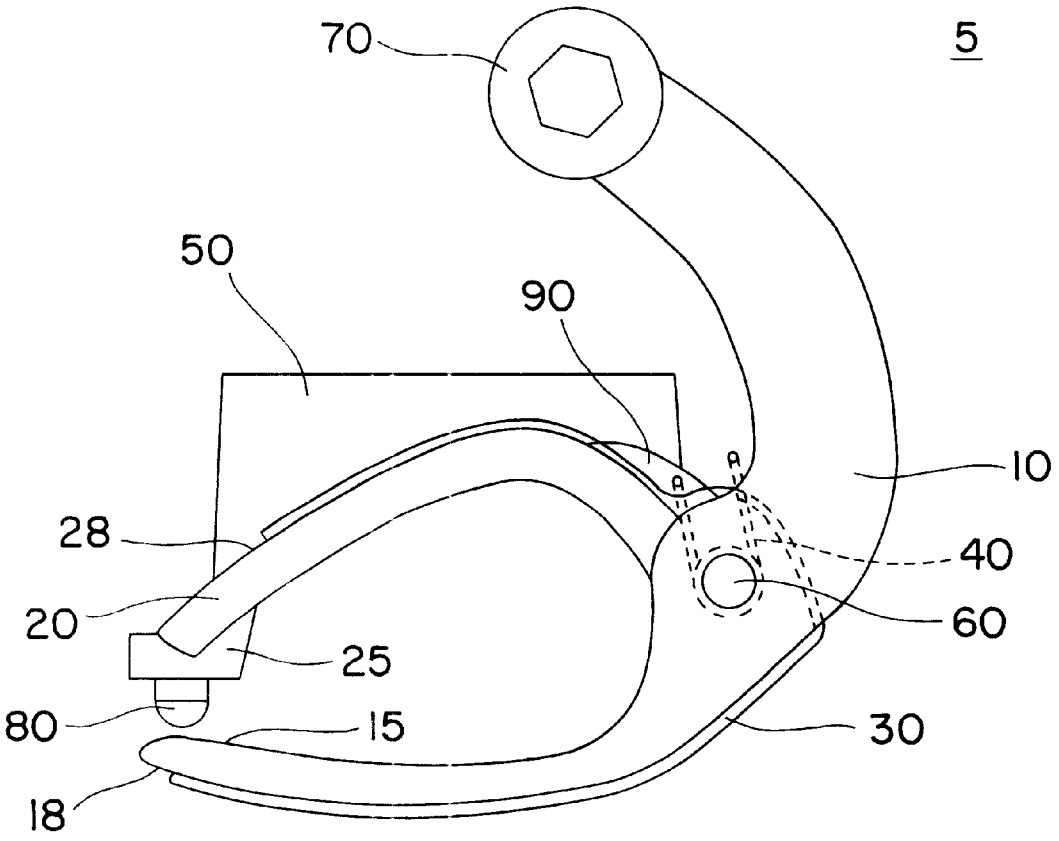
FIG. 1 is a side elevational view of a preferred gripper assembly of the present invention.
Figure 2:
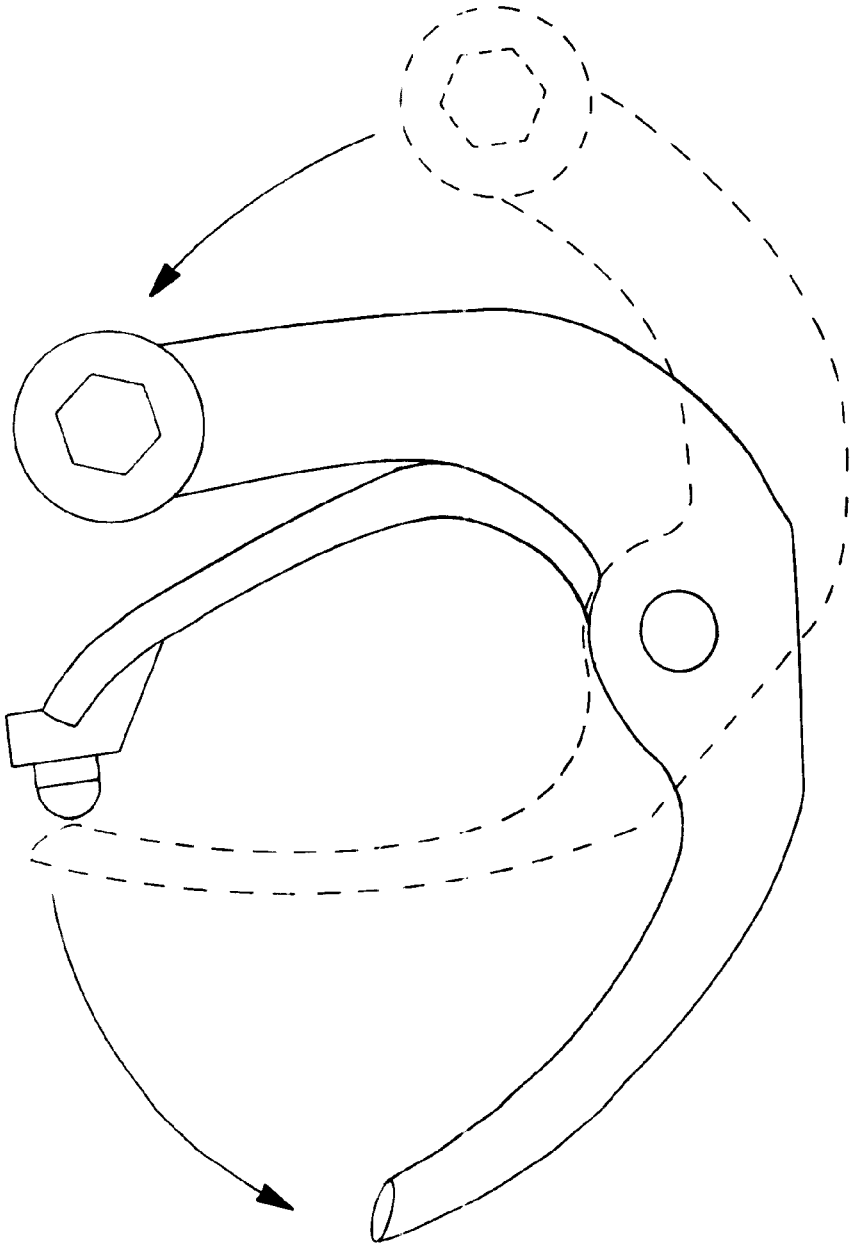
FIG. 2 is a side elevational view of a preferred gripper assembly of the present invention depicting the gripper assembly in a clamping position in hidden line format and in an open position in solid line format.
Figure 3:
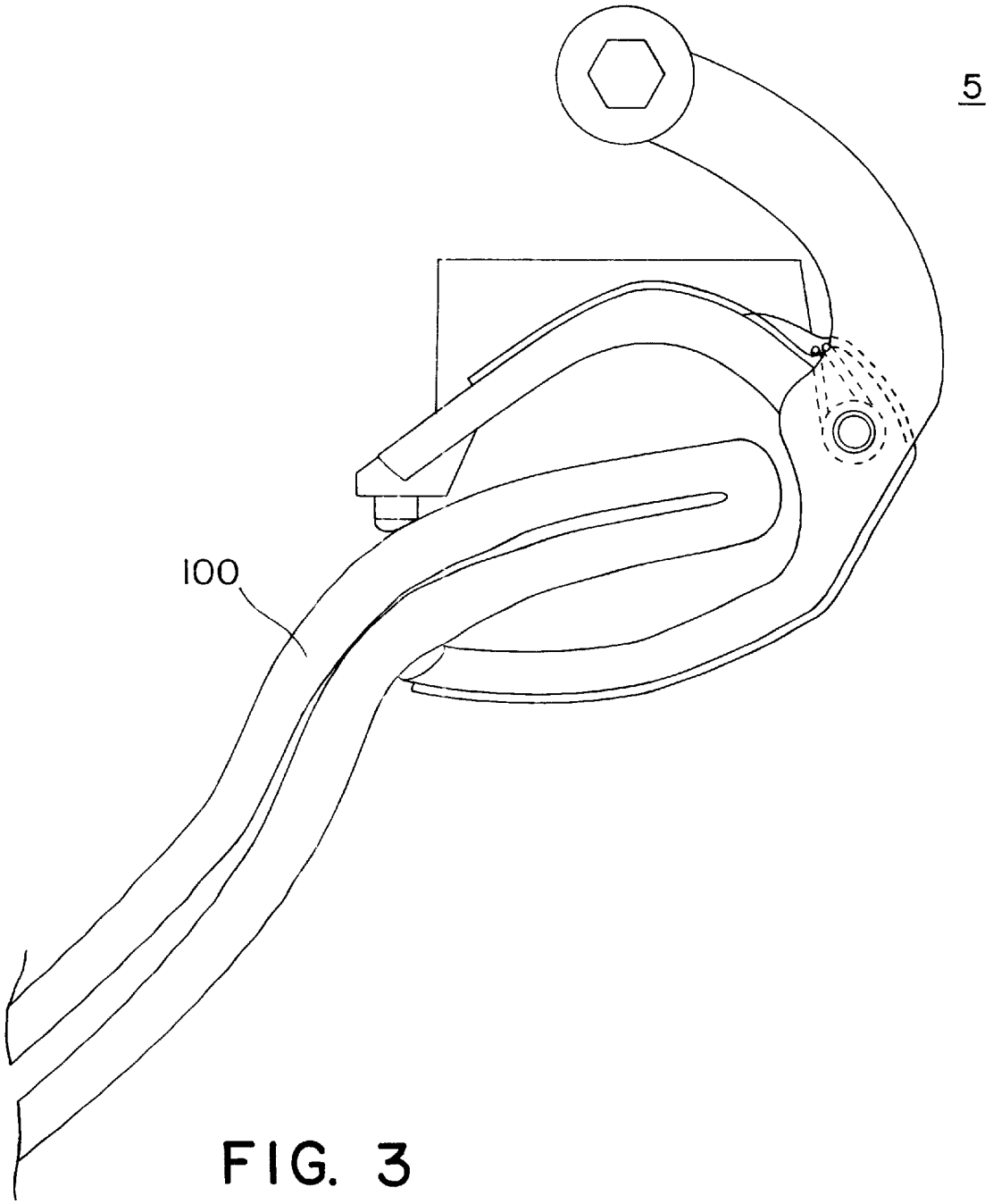
FIG. 3 is a side elevational view of a preferred gripper assembly of the present invention in a clamping position holding a printed product.

FIGS. 1–3 illustrate a gripper assembly 5 of the present invention for use in a conveying device for single-sheet or multi-sheet printed products (not shown), for example newspapers. The gripper assembly 5 is adapted to be mounted to the conveying device (not shown) at connection site 50. The gripper assembly 5 includes a first gripper part 10, having a clamping surface 15 and an external surface 18; a second gripper part 20, having a clamping surface 25 and an external surface 28; a spring element 40 and at least one conforming biaser 30.

The first gripper part 10 and the second gripper part 20 are preferably connected at a common axis 60 for pivotal movement of the first gripper part 10 relative to the second gripper part 20 through an infinite number of positions between a clamping position (shown in hidden line format) and an open position (shown in solid line format), see FIG. 2. The gripper assembly 5 is shown clamping a printed product 100 in FIG. 3.

The first gripper part 10 preferably has at a distal end thereof at least one roller 70. The at least one roller 70 being configured to cooperate with a contacting cam surface of a conveying device for printed products (not shown), particularly newspapers, wherein the contacting cam surface operates in combination with the at least one roller 70 to force the gripper assembly 5 into an open position to facilitate the pick-up or drop-off of a printed product or part thereof The second gripper part 20 preferably comprises a contact nub 80 on its clamping surface 25. The contact nub 80 preferably comprises a resilient material having a high coefficient of friction to facilitate a strong hold on a printed product when clamped by the gripper assembly. Most preferably, the contact nub 80 is made of natural or synthetic rubber.

The spring element 40 biases the gripper assembly 5 towards its clamping position. Preferably, the spring element 40 comprises a coil torsion spring arranged between the first gripper part 10 and the second gripper part 20.

The conforming biaser 30 may be constructed of any resilient material which is capable of undergoing repeated transformation in a gripper assembly 5 between a clamping position and an open position while retaining its biasing strength. Preferably, the conforming biaser 30 is made from a resilient material such as spring steel. Most preferably, the conforming biaser 30 is made from #1074 spring steel.

One skilled in the art will know how to select an appropriate material of construction for the conforming biaser 30 for any given application. Also, one skilled in the art will know how to vary the configuration of the conforming biaser 30 given the material of construction thereof to suit a given application. For example, one skilled in the art will know to select a proper material of construction and configuration to supply the additional gripping force required to facilitate handling of the printed products for a given application, i.e. a given publication thickness and weight. Furthermore, one skilled in the art will know how to configure the conforming biaser 30 to facilitate its incorporation into a given gripper assembly.

Figure 4:
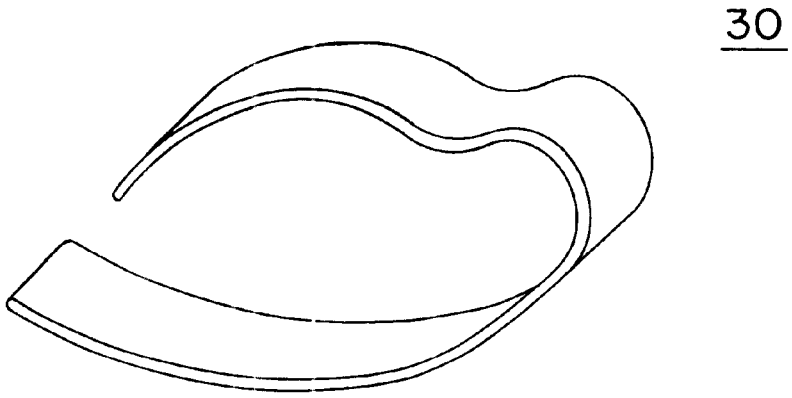
FIG. 4 is a side perspective view of a preferred conforming biaser of the present invention.
Figure 5:
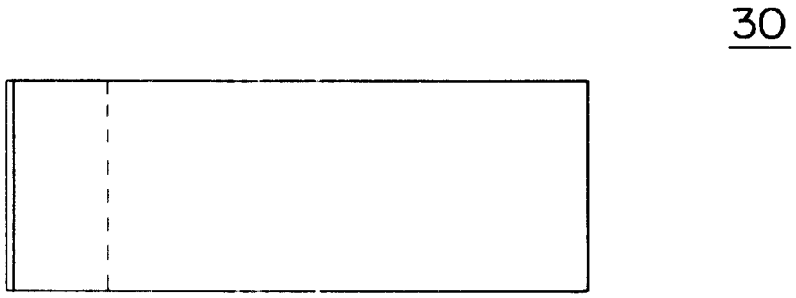
FIG. 5 is a top view of the preferred conforming biaser of the present invention depicted in FIG. 4.
Figure 6:
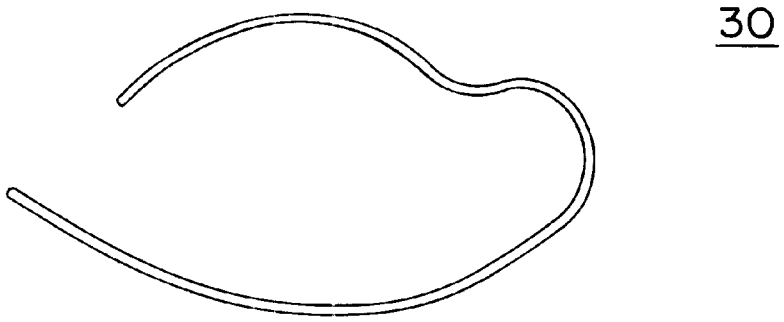
FIG. 6 is a side elevational view of the preferred conforming biaser of the present depicted in FIG. 4; and, FIG. 7 is a top view of a preferred second gripper part of a preferred gripper assembly of the present invention.

In a most preferred aspect of the present invention, the conforming biaser 30 is made of #1074 spring steel 0.64 mm in thickness and is configured as depicted in FIGS. 4 to 6. Specifically, FIG. 4 is a side perspective view of the preferred configuration of the conforming biaser 30. FIG. 5 is a top plan view of the preferred configuration of the conforming biaser 30 depicted in FIG. 4. FIG. 6 is a side elevational view of the preferred configuration of the conforming biaser 30 depicted in FIG. 4.

In a preferred embodiment of the present invention, the conforming biaser 30 slides into engagement with the external surfaces of the first and second gripper parts 18 and 28.

In yet another preferred embodiment of the present invention, the force-imparted by the conforming biaser 30 will operate, in part, to marry the conforming biaser 30 to the external surfaces of the first and second gripper parts 18 and 28.

Figure 7:
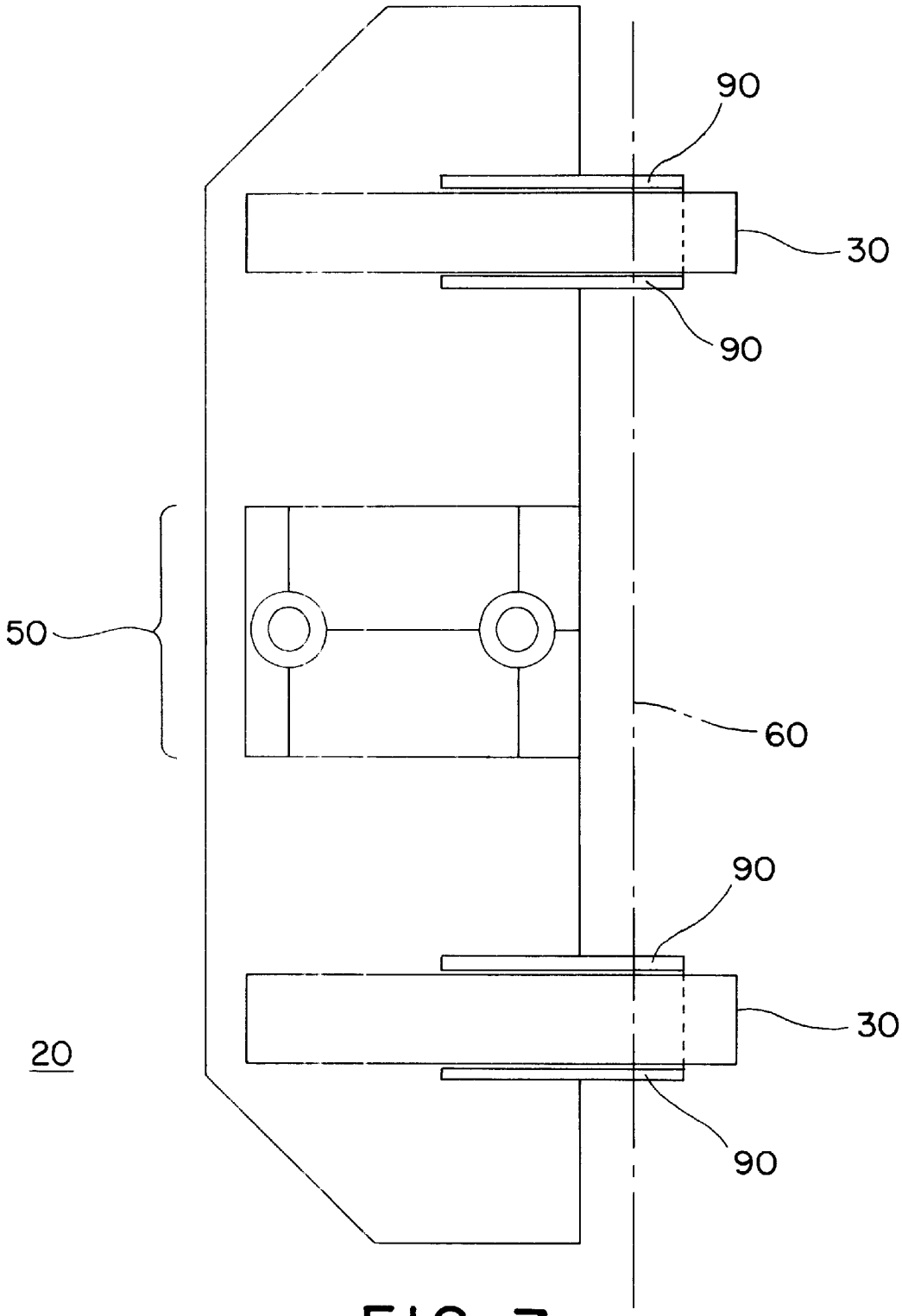

In yet another preferred embodiment of the present invention, the external surface of at least one of the first gripper part 10 or the second gripper part 20 will have at least one elevated ridge which cooperates with the at least one conforming biaser 30 to seat the at least one conforming biaser 30 in a particular location on the external surfaces of the first and second gripper parts. More preferably, at least one of the first gripper part 10 and the second gripper part 20 will have at least one pair of elevated ridges 90; still more preferably, at least one pair of parallel elevated ridges; yet still more preferably, at least one pair of elevated ridges 90 which extend perpendicularly to the common axis 60. For example, FIG. 7 depicts a preferred configuration of the second gripper part 20, wherein the second gripper part has two pairs of elevated ridges 90 which extend perpendicularly to the common axis 60 and which are designed to cooperate with two conforming biasers 30 configured as depicted in FIGS. 4–6 to seat the conforming biasers 30 in the location depicted in FIG. 7 on the external surface of the second gripper part 20.

The present invention also provides a method for modifying a gripper assembly to facilitate the handling of large or heavy issues of printed matter, for example, the Sunday edition of a daily newspaper. Specifically, the present invention provides a method for modifying a gripper assembly having: (a) a first gripper part, having a clamping surface and an external surface; (b) a second gripper part, having a clamping surface and an external surface; wherein the first gripper part and the second gripper part are connected together for pivotal movement about a common axis, the first gripper part being pivotable between an open position and a clamping position in which it cooperates with the second gripper part to clamp a printed product under spring force; and (c) a spring element which is arranged between the first gripper part and the second gripper part and which biases the first gripper part into the clamping position, wherein the method includes the step of installing into the gripper assembly at least one conforming biaser which conforms to the external surfaces of the first and second gripper parts and imparts a force biasing the first gripper part to the clamping position. Preferably, the at least one conforming biaser may be installed and removed from the gripper assembly without the use of tools.

The present invention having been disclosed in connection with the foregoing embodiments, additional embodiments will now be apparent to persons skilled in the art. The present invention is not intended to be limited to the embodiments specifically mentioned, and accordingly reference should be made to the appended claims rather than the foregoing discussion, to assess the spirit and scope of the present invention in which exclusive rights are claimed.

In the claim:

1. In combination, a first gripper part and a second gripper part connected together for pivotal movement about a common axis, said first gripper part being pivotable between an open position and a clamping position in which it cooperates with the second gripper part to clamp a printed product under spring force, wherein the first gripper part and the second gripper part have a clamping surface and an external surface;

a spring element, wherein the spring element is arranged between the first gripper part and the second gripper part and wherein the spring element biases the first gripper part to the clamping position; and, a conforming biaser which conforms to the external surfaces of the first gripper part and the second gripper part and imparts a force biasing the first gripper part to the clamping position.

2. The combination of claim 1, wherein the conforming biaser slides into engagement with the external surfaces of the first and second gripper parts.

3. The combination of claim 1, wherein the force imparted by the conforming biaser further operates to many the conforming biaser to the external surfaces of the first and second gripper parts.

4. The combination of claim 1, wherein the external surface of at least one of the first gripper part and the second gripper part further comprises at least one elevated ridge.

5. The combination of claim 4, wherein the at least one elevated ridge cooperates with the conforming biaser to seat the conforming biaser in a particular location on the external surfaces of the first and second gripper parts.

6. The combination of claim 5, wherein the at least one elevated ridge extends perpendicularly to the common axis.

7. In combination, a first gripper part and a second gripper part connected together for pivotal movement about a common axis, said first gripper part being pivotable between an open position and a clamping position in which it cooperates with the second gripper part to clamp a printed product under spring force, wherein the first gripper part and the second gripper part have an internal clamping surface and an external surface;

a spring element which is arranged between the first gripper part and the second gripper part, the spring element being biased to move the first gripper part into the clamping position; and, a pair of conforming biasers which conform to the external surfaces of the first gripper part and the second gripper part and impart a force biasing the first gripper part to the clamping position.

8. The combination of claim 7, wherein the pair of conforming biasers slide into engagement with the external surfaces of the first and second gripper parts.

9. The combination of claim 7, wherein the force imparted by the pair of conforming biasers further operates to marry the pair of conforming biasers to the external surfaces of the first and second gripper parts.

10. The combination of claim 7, wherein the external surface of at least one of the first gripper part and the second gripper part further comprises at least one elevated ridge.

11. The combination of claim 10, wherein the at least one elevated ridge cooperates with the pair of conforming biasers to seat the biasers in a particular location on the external surfaces of the first and second gripper parts.

12. The combination of claim 11, wherein the external surface of at least one of the first gripper part and the second gripper part comprises at least two pair of elevated ridges.

13. The combination of claim 12, wherein the elevated ridges are parallel to one another.

14. The combination of claim 13, wherein the external surfaces of both the first gripper part and the second gripper part comprise two pair of elevated ridges.

15. A gripper assembly for a conveying device for printed products, comprising:

a first gripper part, having a clamping surface and an external surface;

a second gripper part, having a clamping surface and an external surface; wherein the first gripper part and the second gripper part are connected together for pivotal movement about a common axis, the first gripper part being pivotable between an open position and a clamping position in which it cooperates with the second gripper part to clamp a printed product under spring force;

a spring element, wherein the spring element is arranged between the first gripper part and the second gripper part and wherein the spring element is biased to move the first gripper part into the clamping position; and, at least one conforming biaser, wherein the at least one conforming biaser conforms to the external surfaces of the first gripper part and the second gripper part and wherein the at least one conforming biaser imparts a force biasing the first gripper part to the clamping position;

wherein the at least one conforming biaser slides into engagement with the external surfaces of the first and second gripper parts and wherein the force imparted by the at least one conforming biaser further operates to many the at least one conforming biaser to the external surfaces of the first and second gripper parts.

16. The gripper assembly of claim 15, wherein the external surface of at least one of the first gripper part and the second gripper part further comprises at least one elevated ridge which cooperates with the at least one conforming biaser to seat the at least one conforming biaser in a particular location on the external surfaces of the first and second gripper parts.

17. The gripper assembly of claim 15, wherein the at least one conforming biaser can be installed or removed from the gripper assembly without the use of tools.

18. A method for modifying a gripper assembly to impart thereto an increased clamping force, comprising installing at least one conforming biaser, wherein the gripper assembly comprises:

a first gripper part and a second gripper part connected together for pivotal movement about a common axis, said first gripper part being pivotable between an open position and a clamping position in which it cooperates with the second gripper part to clamp a printed product under spring force, wherein the first gripper part and the second gripper part have a clamping surface and an external surface; and, a spring element, wherein the spring element is arranged between the first gripper part and the second gripper part and wherein the spring element is biased to move the first gripper part into the clamping position; and, wherein the at least one conforming biaser conforms to the external surfaces of the first gripper part and the second gripper part; wherein the at least one conforming biaser imparts a force biasing the first gripper part into the clamping position; wherein the at least one conforming biaser slides into engagement with the external surfaces of the first and second gripper parts; and, wherein the force imparted by the at least one conforming biaser further operates to marry the at least one conforming biaser to the external surfaces of the first and second gripper parts.

19. The method of claim 18, wherein no tools are required to install the at least one conforming biaser.

20. A conveying device for single-sheet or multi-sheet printed products comprising at least one gripper assembly, comprising:

a first gripper part, having a clamping surface and an external surface;

a second gripper part, having a clamping surface and an external surface; wherein the first gripper part and the second gripper part are connected together for pivotal movement about a common axis, the first gripper part being pivotable between an open position and a clamping position in which it cooperates with the second gripper part to clamp a printed product under spring force;

a spring element, wherein the spring element is arranged between the first gripper part and the second gripper part and wherein the spring element is biased to move the first gripper part into the clamping position; and, at least one conforming biaser; wherein the at least one conforming biaser conforms to the external surfaces of the first gripper part and the second gripper part and imparts a force biasing the first gripper part to the clamping position; wherein the at least one conforming biaser slides into engagement with the external surfaces of the first and second gripper parts; wherein the force imparted by the at least one conforming biaser further operates to marry the at least one conforming biaser to the external surfaces of the first and second gripper parts; and, wherein the external surface of at least one of the first gripper part and the second gripper part comprises at least one elevated ridge which cooperates with the at least one conforming biaser to seat the at least one conforming biaser in a particular location on the external surfaces of the first and second gripper parts.

* * * * *